US008950462B2

(12) United States Patent
Cha

(10) Patent No.: US 8,950,462 B2
(45) Date of Patent: Feb. 10, 2015

(54) BLIND OF UNITED BLIND BY WEAVING

(76) Inventor: Ki Cheol Cha, Daegu (KR)

( * ) Notice: Subject to any disclaimer, the term of this patent is extended or adjusted under 35 U.S.C. 154(b) by 0 days.

(21) Appl. No.: 13/329,780

(22) Filed: Dec. 19, 2011

(65) Prior Publication Data

US 2012/0085504 A1 Apr. 12, 2012

Related U.S. Application Data

(63) Continuation of application No. 12/091,149, filed as application No. PCT/KR2007/003582 on Jul. 26, 2007.

(30) Foreign Application Priority Data

Nov. 24, 2006 (KR) ..... 10-2006-0117059

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/24*** | (2006.01) |
| ***D03D 1/08*** | (2006.01) |
| ***D03D 9/00*** | (2006.01) |
| ***D03D 11/02*** | (2006.01) |

(Continued)

(52) U.S. Cl.

CPC .. *E06B 9/24* (2013.01); *D03D 1/08* (2013.01); *D03D 9/00* (2013.01); *D03D 11/02* (2013.01); *D03D 15/00* (2013.01); *D03D 15/08* (2013.01); *D10B 2401/041* (2013.01); *D10B 2503/02* (2013.01); *D10B 2503/03* (2013.01)

USPC ..... 160/84.05; 160/121.1; 139/384 A

(58) Field of Classification Search

CPC ..... E06B 9/26; E06B 9/262; E06B 9/2622; E06B 9/2627; E06B 9/386; D03D 3/00; D03D 25/005; D03D 1/08

USPC ..... 160/84.05, 121.1, 120, 87, 168.1 R; 139/383 R, 384 R, 387 R, 384 A, 139/408–415, 420 R, 426 R, 383 B

See application file for complete search history.

(56) References Cited

U.S. PATENT DOCUMENTS

| | | | | |
|---|---|---|---|---|
| 1,937,342 A | | 11/1933 | Higbie | 359/596 |
| 2,140,049 A | | 12/1938 | Grauel | 160/121.1 |
| 2,613,694 A | * | 10/1952 | French et al. | 139/384 A |

(Continued)

FOREIGN PATENT DOCUMENTS

| | | |
|---|---|---|
| JP | 3115610 U | 9/2005 |
| KR | 20-1989-0007131 Y1 | 10/1989 |

(Continued)

OTHER PUBLICATIONS

Article "Sectional Warping" with partial English translation, Power Loom Mechanism, 1991, 4 pages.

(Continued)

*Primary Examiner* — Katherine Mitchell
*Assistant Examiner* — Jeremy Ramsey

(57) ABSTRACT

The present invention provides a textile blind united by weaving, which is formed as a single body by weaving slat textiles along a width between a front textile and a back textile in parallel with each other, wherein the slat textiles are arranged along the height of the front and back textiles to make the textile blind easily block lights.

13 Claims, 8 Drawing Sheets

(51) Int. Cl.
*D03D 15/00* (2006.01)
*D03D 15/08* (2006.01)

(56) References Cited

U.S. PATENT DOCUMENTS

| | | | | |
|---|---|---|---|---|
| 2,801,456 | A | 8/1957 | Walters et al. | 28/158 |
| 2,856,324 | A | 10/1958 | Janowski | 156/65 |
| 3,384,519 | A | 5/1968 | Froget | 156/65 |
| 4,019,554 | A | 4/1977 | Rasmussen | 160/84.02 |
| 5,285,838 | A | 2/1994 | Rapp et al. | 160/168.1 R |
| 5,313,999 | A | 5/1994 | Colson et al. | |
| 5,394,922 | A | 3/1995 | Colson et al. | 160/121.1 |
| 5,419,385 | A | 5/1995 | Vogel et al. | 160/121.1 |
| 5,454,414 | A | 10/1995 | Colson et al. | 160/84.02 |
| 5,558,925 | A | 9/1996 | Fritzman | 428/181 |
| 5,642,633 | A | 7/1997 | Pedall | 66/193 |
| 5,664,613 | A | 9/1997 | Jelic | 160/84.05 |
| 5,691,031 | A | 11/1997 | Swiszcz et al. | 428/116 |
| 5,753,338 | A * | 5/1998 | Jelic et al. | 428/116 |
| 6,001,199 | A | 12/1999 | Colson et al. | 156/65 |
| 6,112,797 | A | 9/2000 | Colson et al. | 160/121.1 |
| 6,164,363 | A | 12/2000 | Colson et al. | 160/84.05 |
| 6,302,982 | B1 | 10/2001 | Corey et al. | 156/73.4 |
| 6,377,384 | B2 | 4/2002 | Corey et al. | 359/227 |
| 6,484,786 | B1 | 11/2002 | Ruggles et al. | 160/84.05 |
| 6,575,222 | B2 | 6/2003 | Corey et al. | 160/84.05 |
| 6,634,409 | B2 | 10/2003 | Corey et al. | 160/236 |
| 6,688,370 | B1 | 2/2004 | Nien | |
| 6,729,379 | B1 | 5/2004 | Nien | 160/121.1 |
| 6,745,811 | B1 | 6/2004 | Nien | 160/121.1 |
| 6,823,923 | B2 | 11/2004 | Palmer et al. | 160/84.05 |
| 7,059,378 | B2 | 6/2006 | Colson et al. | 160/121.1 |
| D600,057 | S | 9/2009 | Cha | D6/575 |
| 7,694,696 | B2 | 4/2010 | Chang et al. | 139/423 |
| 2001/0045110 | A1 | 11/2001 | Kolmes et al. | 66/174 |
| 2004/0074611 | A1 | 4/2004 | Colson et al. | 160/84.05 |
| 2004/0084158 | A1 | 5/2004 | Colson et al. | 160/84.05 |
| 2004/0226663 | A1 | 11/2004 | Smith et al. | 160/84.05 |
| 2005/0194104 | A1 | 9/2005 | Nien | 160/84.05 |
| 2007/0079943 | A1 | 4/2007 | Smith et al. | 160/121.1 |
| 2007/0272368 | A1 | 11/2007 | Hoffmann et al. | 160/121.1 |
| 2010/0218841 | A1 * | 9/2010 | Chang et al. | 139/384 A |

FOREIGN PATENT DOCUMENTS

| | | | |
|---|---|---|---|
| KR | 1992-016747 | U | 9/1992 |
| KR | 10-1998-024837 | A | 7/1998 |
| KR | 10-0209125 | B1 | 4/1999 |
| KR | 20-0416584 | Y1 | 5/2006 |
| KR | 10-0790026 | B1 | 12/2007 |
| KR | 10-0815572 | B1 | 3/2008 |
| KR | 10-0815579 | B1 | 3/2008 |
| KR | 10-0844233 | B1 | 6/2008 |
| KR | 10-0893364 | B1 | 4/2009 |
| WO | 2005019584 | A2 | 3/2005 |

OTHER PUBLICATIONS

Article "Technical Development Trend of three-Dimensional Textiles" with partial English translation, 2008, 13 pages.
International Search Report together with Written Opinion dated Aug. 28, 2007.

* cited by examiner

BLIND OF UNITED BLIND BY WEAVING

CROSS REFERENCE TO RELATED APPLICATIONS

This application is a continuation of U.S. application Ser. No. 12/091,149, filed Apr. 22, 2008, which is a 35 USC §371 National Phase Entry Application from PCT/KR2007/003582, filed Jul. 26, 2007, and designating the United States, which claims priority under 35 U.S.C. §119 based on Korean Patent Application No. 10-2006-0117059 filed Nov. 24, 2006, which is incorporated herein in its entirety.

TECHNICAL FIELD

The present invention relates to a textile blind united by weaving, and in particular, to a textile blind formed of yarns, wherein the textile blind has a front textile, a back textile, and a slat textile for blocking lights, and each of the textiles is united with a front uniting part and a back uniting part by weaving a woof.

BACKGROUND ART

In general, curtains and blinds are installed on window or doorways of a building and are used for blocking solar light, external sight, noise and cold, and are also used as an important factor of indoor decoration for enhancing indoor beauty in accordance with combination of colors that can be harmonized with indoor walls or glasses.

The blind operates as follows. When a rope for pulling up or down the blind is pulled down, a reeling driver rotates in forward and backward directions, which leads to a forward and backward directional rotation of a reel pole so that a roll screen is rolled down from the reel pole or rolled up to adjust a degree of covering a window. However, such a method cannot adjust an amount of lights flowing indoor at all while the blind is pulled down across the entire window.

To cope with such a problem, several kinds of Venetian blinds using a plate-shaped slat are disclosed for adjusting lighting, however, the conventional Venetian blind not only has a complicated structure for adjusting brightness but also has a very burdensome adjusting function and a high cost unit of manufacture.

Further, the Venetian blind is formed of metal or wood instead of a conventional synthetic resin due to an upgrade of the slat, which causes the blind to be much weighted so that it is difficult to install the blind.

In a case of a conventional textile blind 20 shown in FIG. 1 among such blinds as described above, a textile slat 23 is formed between a front side 21 and the back side 22 by means of thermal treatment, and an adhered part 24 bonded by the thermal treatment is fallen apart at this time when it is exposed to solar lights for a long period of time, so that the blind cannot properly act its own function.

DISCLOSURE

Technical Problem

The present invention is directed to a textile blind having a united structure by weaving for enhancing durability and coherence of the structure.

Technical Solution

One aspect of the present invention is to provide a textile blind, which includes, a front textile, a back textile in parallel with the front textile, and a slat textile having a predetermined width along a width between the front and back textiles, wherein both ends of the slat textile are united with the respective front and back textiles by weaving to form respective front uniting and back uniting parts. A plurality of the slat textiles are arranged along a height direction of the front and back textiles, and a front uniting part united with one slat textile has the same height as a back uniting part united with an adjacent slat textile to simplify adjustment and structure of the textile blind.

A low melt fiber is used as the woof of the textile blind, and the textile blind is woven to be united and then heat is applied by a Tenter to allow the low melt fiber to be melt-bonded so that the textile structure of the textile blind can be maintained and durability of the same can be enhanced.

In addition, the woof of the textile blind is mixed with a rubber thread to prevent folds from occurring after manufacture of the textile blind.

Further, each of the front and back textiles has a mesh structure, and each mesh of one of the front and back textiles has a square shape and each mesh of the other of the front and back textiles has a shape with a ratio of 1 by 1.5 to 2.5 to prevent a moire phenomenon.

Advantageous Effects

A textile blind of the present invention united by weaving and then is produced, so that it can be easily adjusted and installed by aid of its simplified structure and its total light weight.

A low melt fiber is used as the woof of the textile blind, and the textile blind is woven to be united and then heat is applied by a Tenter to allow the low melt fiber to be melt-bonded so that the textile structure of the textile blind can be maintained and durability of the same can be enhanced.

In addition, the woof of the textile blind is mixed with a rubber thread to prevent folds from occurring after manufacture of the textile blind.

Further, each of the front and back textiles has a mesh structure, and each mesh of one of the front and back textiles has a square shape, and each mesh of the other of the front and back textiles has a shape with a ratio of horizontal and vertical lengths different from each other, thereby preventing a moire phenomenon.

DESCRIPTION OF DRAWINGS

FIG. 2 conceptually enlarges the area between the front uniting part and the back uniting part.

FIGS. 7 to 9 are state diagrams illustrating usage of a textile blind woven in accordance with the present invention.

BEST MODE

The present invention provides a textile blind united by weaving, which includes a front textile, a back textile in parallel with the front textile, and a slat textile having a predetermined width along a width between the front and back textiles, wherein both ends of the slat textile are united with the respective front and back textiles by weaving to form respective front uniting and back uniting parts, a plurality of the slat textiles are arranged along a height of the front and back textiles, and the front uniting part of one slat textile has the same height as the back uniting part of an adjacent slat textile, so that the textile blind configured as described above is applied to a typical blind structure to facilitate installment, adjustment, blocking solar lights and lighting.

Figure 4:
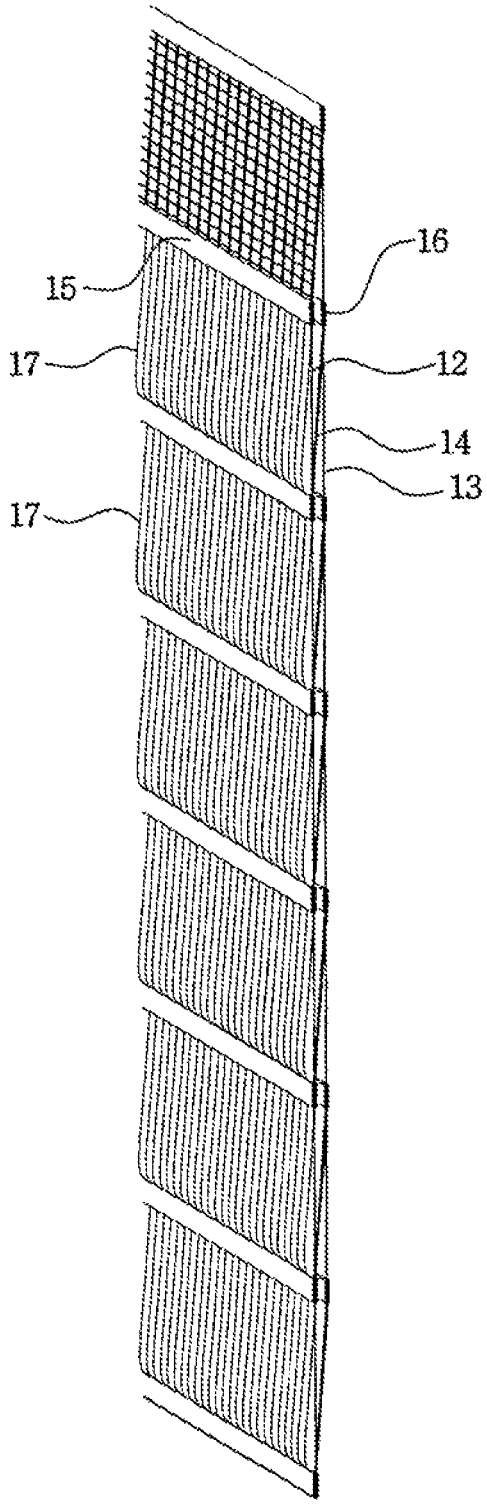
FIGS. 4 to 8 are diagrams illustrating work flow processes of a textile blind woven in accordance with the present invention.
Figure 5:
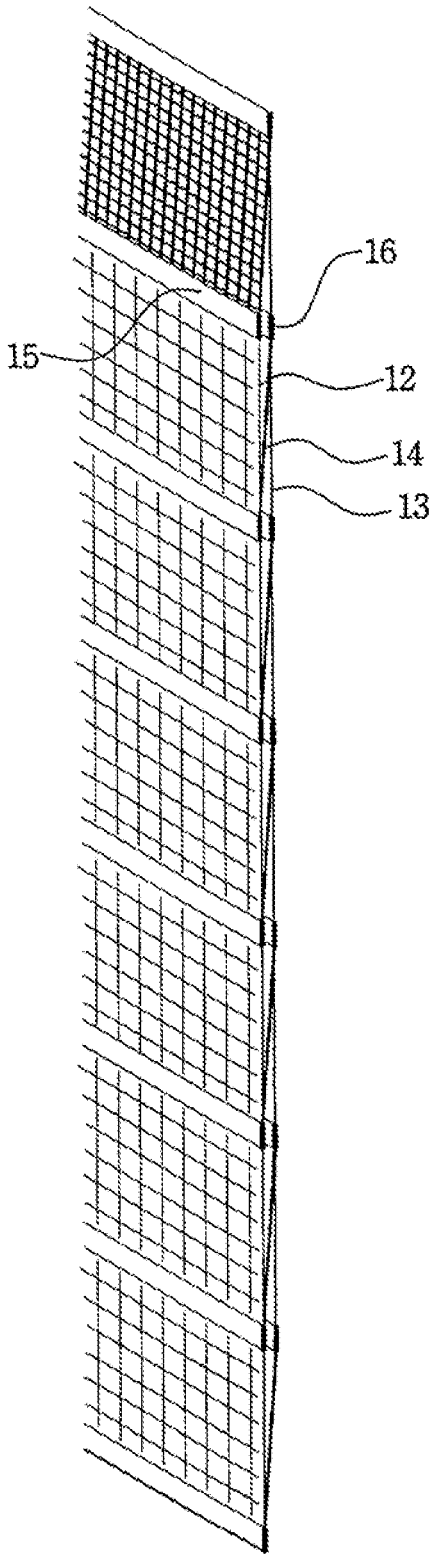
Figure 6:
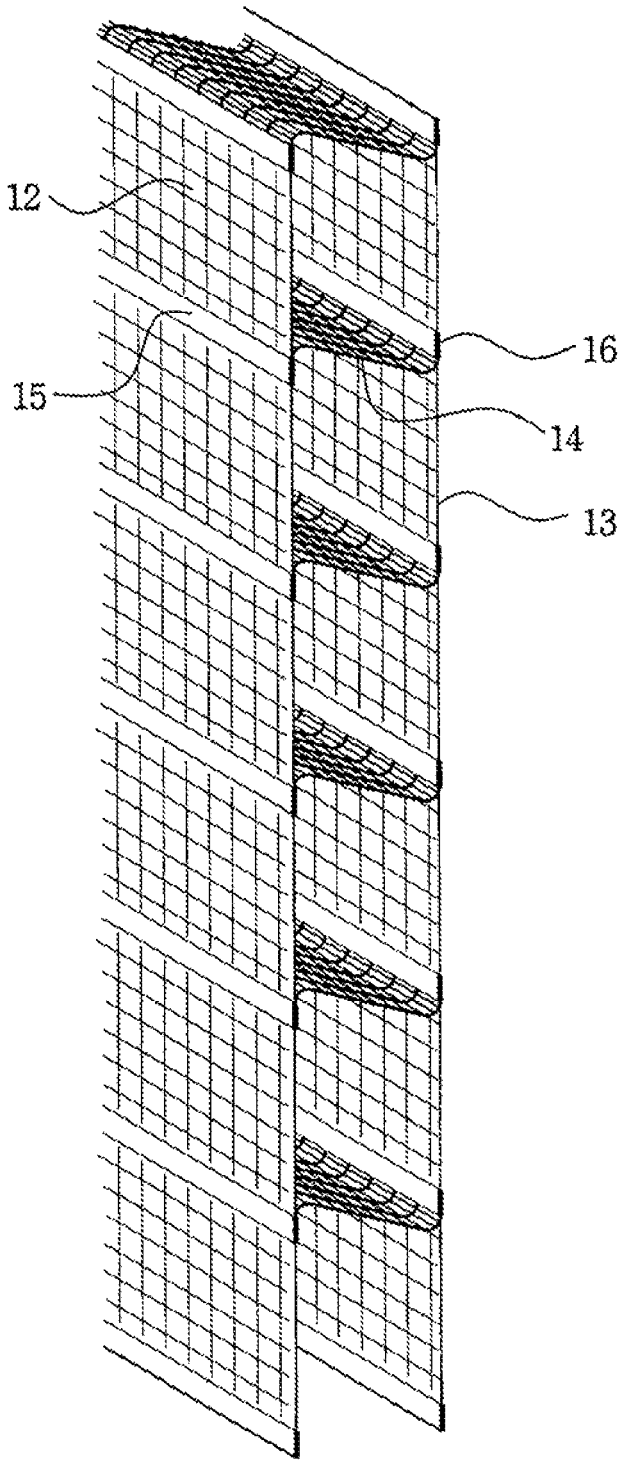

According to the textile blind 10 of the present invention, as shown in FIGS. 4 to 6, warps are woven by woofs to form a front textile 12 and a back textile 13 for ventilation, and a plurality of slat textiles 14 for blocking lights, respectively, thereby resulting in the textile blind 10. Each of the slat textiles 14 is united with the front textile 12 and the back textile 13 along both ends of its longitudinal direction to form respectively front uniting part 15 and back uniting part 16.

Such a textile blind 10 will now be described in detail with reference to accompanying drawings.

Figure 1:
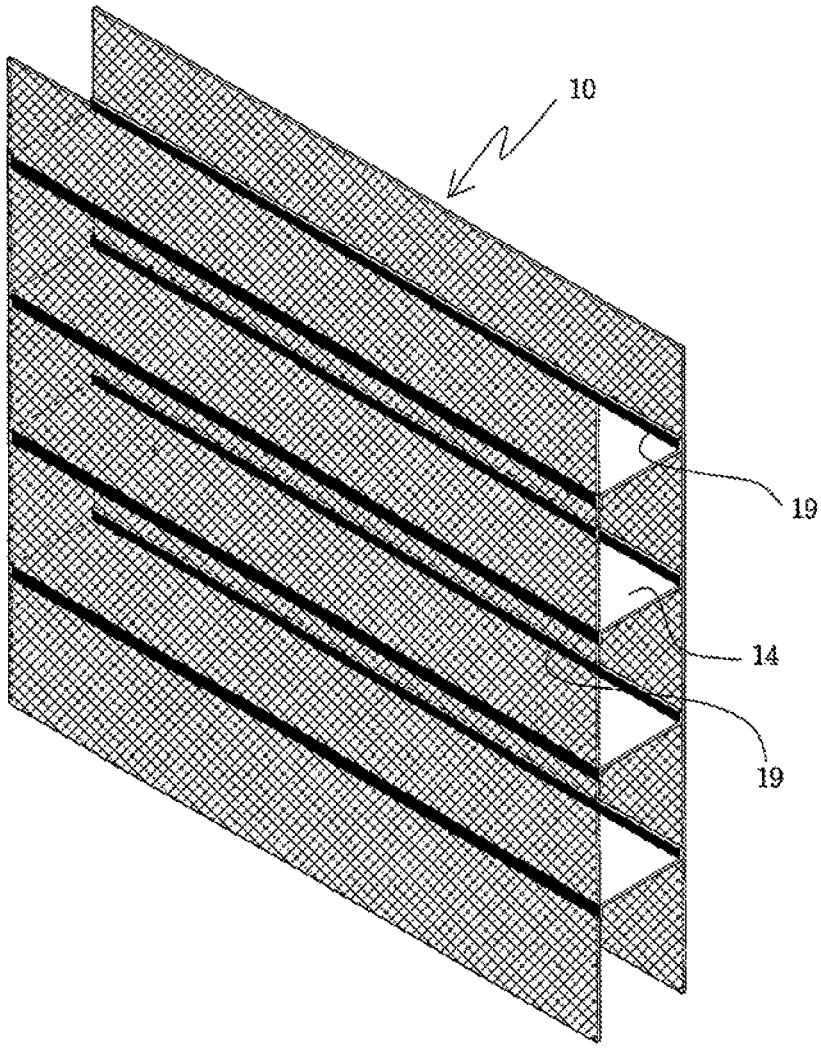
FIG. 1 is a perspective diagram illustrating a blind made by a conventional method.
Figure 2:
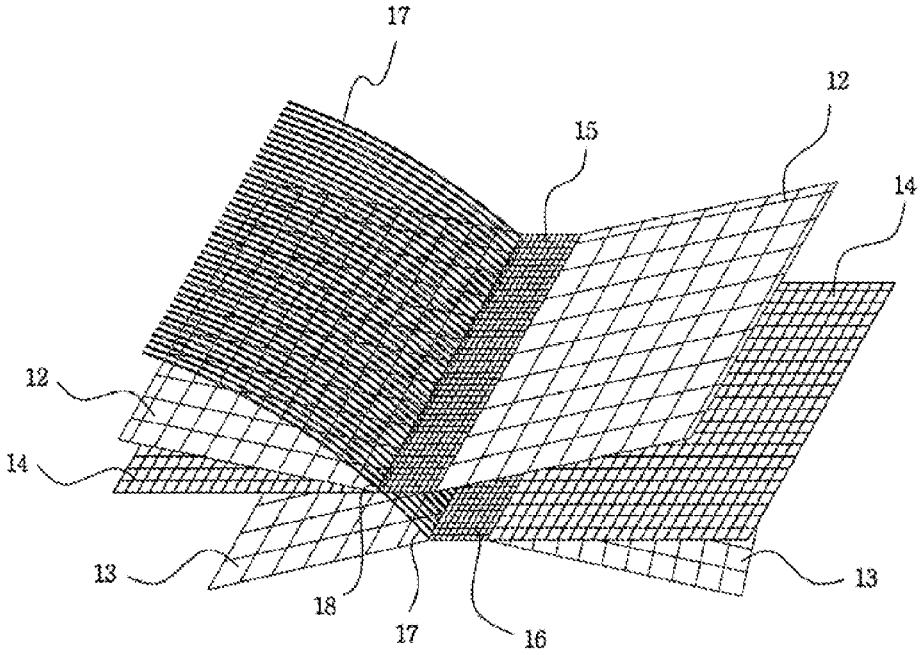
FIG. 2 is a perspective diagram illustrating a textile blind woven by a process of the present invention.
Figure 3:
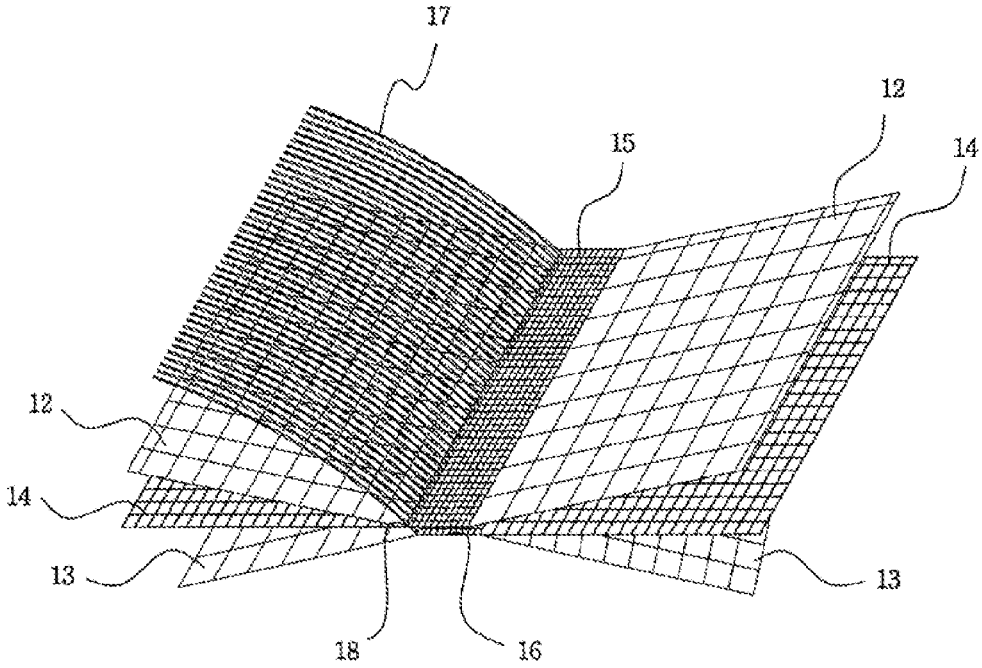
FIG. 3 is a perspective diagram illustrating a textile blind woven by a process of the present invention.

The front textile 12 and the back textile 13 for ventilation and light adjustment are first woven by warps and woofs, respectively. Each of the plurality of slat textiles 14 capable of blocking lights is woven by slat warp 17 and slat woof as shown in FIGS. 2 and 3.

Then, the front textile 12, the back textile 13, and first slat textile 14 are woven by first slat warp 17 and are united with each other by the first front uniting part (see FIG. 6) and the first back uniting part 16 by weaving. That is, they are united with each other by the first front uniting part 15 and the first back uniting part 16 in up and down directions.

Then, the first slat warp 17 is passing through weaving holes 18 formed in a second front uniting part 15 after forming the first back uniting part 16 while an end of a second slat warp 17 united with the second front uniting part 15 is woven by the woof of a second back uniting part 16.

In other word, the second slat warp 17 is first united with the second front uniting part 15 and then is further woven to form the second back uniting part (see FIG. 6). The second slat warp 17 is further woven with woof to form a second slat textile 14 which is capable of blocking lights and connecting between the second front uniting part 15 and the second back uniting part as shown in FIG. 6. Such a weaving process is repeatedly performed.

In more detail, a plurality of the slat textiles 14 are arranged along the height direction (i.e., weaving direction) of the front textile 12 and the back textile 13 in the process as described above. The second front uniting part 15 formed at an end of the second slat textile 14 is disposed at the same level as the first back uniting part 16 united with the first slat textile 14 which is formed next to the second slat textile 14, The first slat textile 14 is overlapped with the second front uniting part 15 and the first back uniting part 16 as shown in FIGS. 2, 3 and 5 when the textile blind 10 is in a flattened state. The slat textile 14 has an area almost equal to the area of the front textile 12 or the back textile 13 on the whole, thereby blocking lights.

Preferably, each of the slat textiles 14 for the textile blind 10 has a width of 30 to 70 mm to minimize hanging-down of the slat textiles 14 and improve an aesthetic sense.

In other words, warps are united with respective woofs by weaving to form the front textile 12, the back textile 13, and the slat textile 14 as one body. In more detail, the front textile 12, the back textile 13, and the first slat textile 14 are woven by the first slat warp 17 to form the first front uniting part 15 and the first back uniting part 16 by weaving. Likewise, the second slat warp 17 is united with the respective woofs by weaving to allow the front textile 12, the back textile 13, and the second slat textile 14 to be united with each other in up and down directions.

The first slat warp 17 is passing through weaving holes 18 formed in the second front uniting part 15 after being united with the first back uniting part 16 while the second slat warp 17 united with the second front uniting part 15 is woven by the woof of the second back uniting part 16, thereby configuring the textile blind 10 united by weaving as shown in FIG. 4.

In other words, the front textile 12 and the back textile 13 are woven with the warps and the respective woofs. The slat textiles 14 are woven with the slat warps 17 and slat woofs. In the front uniting parts 15 and the back uniting parts 16, the slat warps 17 are woven with separate woofs.

Accordingly, the textile blind 10 having the shape as shown in FIG. 4 can be formed. The slat warps 17 are exposed to an external side. The slat warps 17 exposed over the front textile 12 are cut based on the front uniting part 15 or the back uniting part 16 after it is completely united by weaving. As a result, the textile blind 10 is configured as shown in FIG. 5. Meanwhile, the front textile 12 and the back textile 13 have a mesh structure to facilitate ventilation, and each of the slat textiles 14 has a mesh structure to allow external sights to be viewed while lights are not blocked. As such, each of the warps for weaving the front textile 12, the back textile 13, the slat textiles 14, the front uniting parts 15, and the back uniting parts 16 is composed of a synthetic fiber, and has a thickness of 50 to 1500 (denier).

The woof for weaving the front textile 12 and the back textile 13 is composed of a low melt fiber, and has a thickness of 50 to 1500.

In addition, the woof for weaving each of the slat textiles 14 is composed of two threads, that is, a synthetic fiber and a low melt fiber, and the synthetic fiber has a thickness of 270 to 3500 and the low melt fiber has a thickness of 50 to 1500.

The woof for weaving each of the front uniting parts 15 and the back uniting parts 16 is composed of two threads, that is, a synthetic fiber and a low melt fiber, and the synthetic fiber has a thickness of 280 to 3500 and the low melt fiber has a thickness of 50 to 1500.

Thickness and material of warps and woofs of the textile blind 10 as described above are represented in the table 1 below.

TABLE 1

| Name (No.) | Name (No.) | Material | Thickness (D) | Note |
|---|---|---|---|---|
| Front textile (12) | Warp | Synthetic fiber | 50-150 | |
| | Woof | Low melt fiber | 50-150 | |
| Back textile (13) | Warp | Synthetic fiber | 50-150 | |
| | Woof | Low melt fiber | 50-150 | |
| Slat textile (14) | Warp(17) | Synthetic fiber | 50-150 | |
| | Woof | Synthetic fiber<br>Low melt fiber | 280-350<br>50-150 | Composed of two threads |
| Front uniting part (15) | Warp(17) | Synthetic fiber | 50-150 | |
| | Woof | Synthetic fiber<br>Low melt fiber | 280-350<br>50-150 | Composed of two threads |
| Back uniting part (16) | Warp(17) | Synthetic fiber | 50-150 | |
| | Woof | Synthetic fiber<br>Low melt fiber | 280-350<br>50-150 | Composed of two threads |

For reference, the low melt fiber used as each woof of the front textile 12, the back textile 13, the slat textiles 14, the front uniting parts 15, and the back uniting parts 16 is made of a low melt fiber having a melting point of 170 to 220 degrees Celsius (° C.). This is because that the low melt fiber is bonded with the warps such as a synthetic fiber at its melting point due to its characteristic to maintain the respective woven structures, and is not deformed even when an external force is applied, so that the textile blind 10 woven as described above is fixed to maintain its shape by means of melting bond when heat of 170 to 220 degrees Celsius (° C.) is applied thereto by a separate Tenter.

In addition, each woof for weaving the front textile 12, the back textile 13, the front uniting parts 15, and the back uniting parts 16 is mixed (covered) with a rubber thread to prevent folds from occurring after the textile blind is manufactured.

In addition, the textile blind 10 undergoes a flame-retardant treatment so that it is safe against fire. To this end, threads used for the warps and the woof of the front textile 12, the back textile 13, the slat textiles 14, the front uniting parts 15, and the back uniting parts 16 undergo a flame-retardant treatment, or have a property safe against fire configured such that the textile blind is put into a flame-retardant liquid before the woven textile blind 10 is processed by the Tenter.

The front textile 12 and the back textile 13 preferably have a mesh structure, and spaces generated by the mesh structure of the front textile 12 and the back textile 13, instead of having all square shapes, have square holes generated by the mesh structure of one of the front textile 12 and the back textile 13, and holes generated by the mesh structure of the other of the front textile 12 and the back textile 13 with a ratio of 1 by 1.5 to 2.5, thereby preventing a moire phenomenon.

Consequently, when the textile blind 10 is completely woven by the warps and the woofs as shown in FIG. 4, the slat warps 17 are externally opened. The front textile 12 and the back textile 13 face each other and the slat textiles 14 therebetween are successively formed in up and down directions. Heat generating from a Tenter is applied to the textile blind 10 by means of melting bond. Both ends of the textile blind 10 are cut and finished. The protruded slat wraps 17 are removed. The textile blind 10 configured to have the desired length and width again is applied to the conventional blind structure, which is typically used in the same way as the related art as shown in FIGS. 7 to 9.

Figure 7:
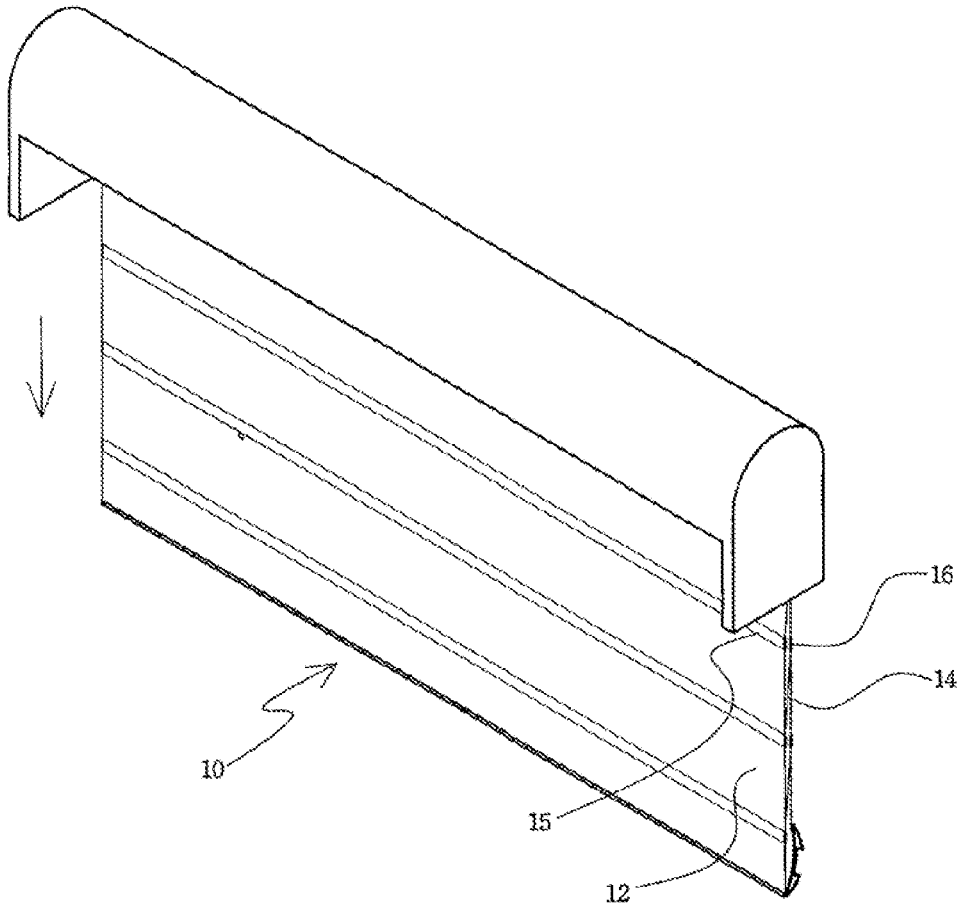

Accordingly, the textile blind 10 formed as described above is assembled with a separate blind cover, and a support matching the width of the slat textiles 14 is fixed at a lower position of the textile blind 10 to prevent shaking after the textile blind 10 is mounted as shown in FIG. 7.

Figure 8:
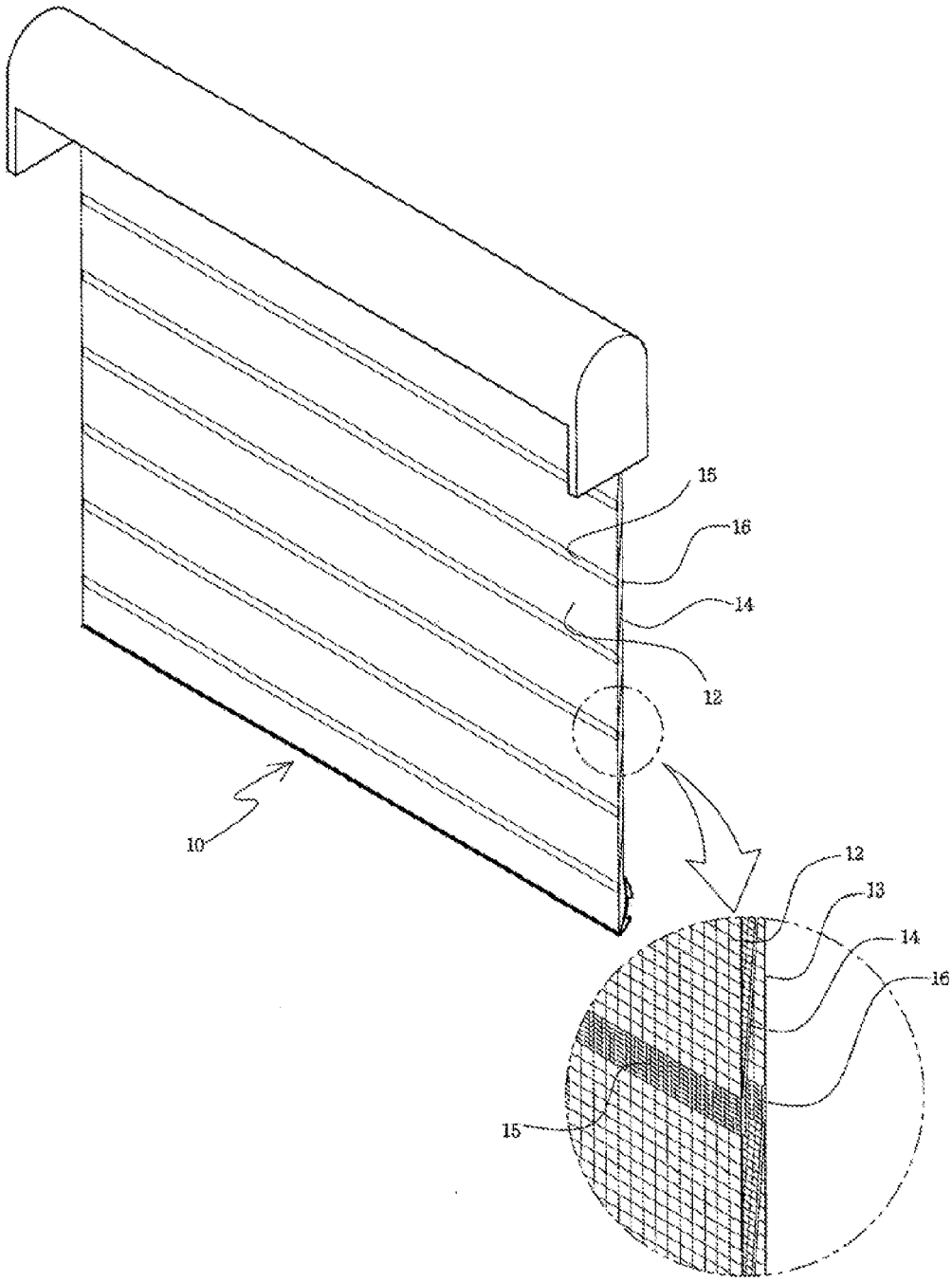
Figure 9:
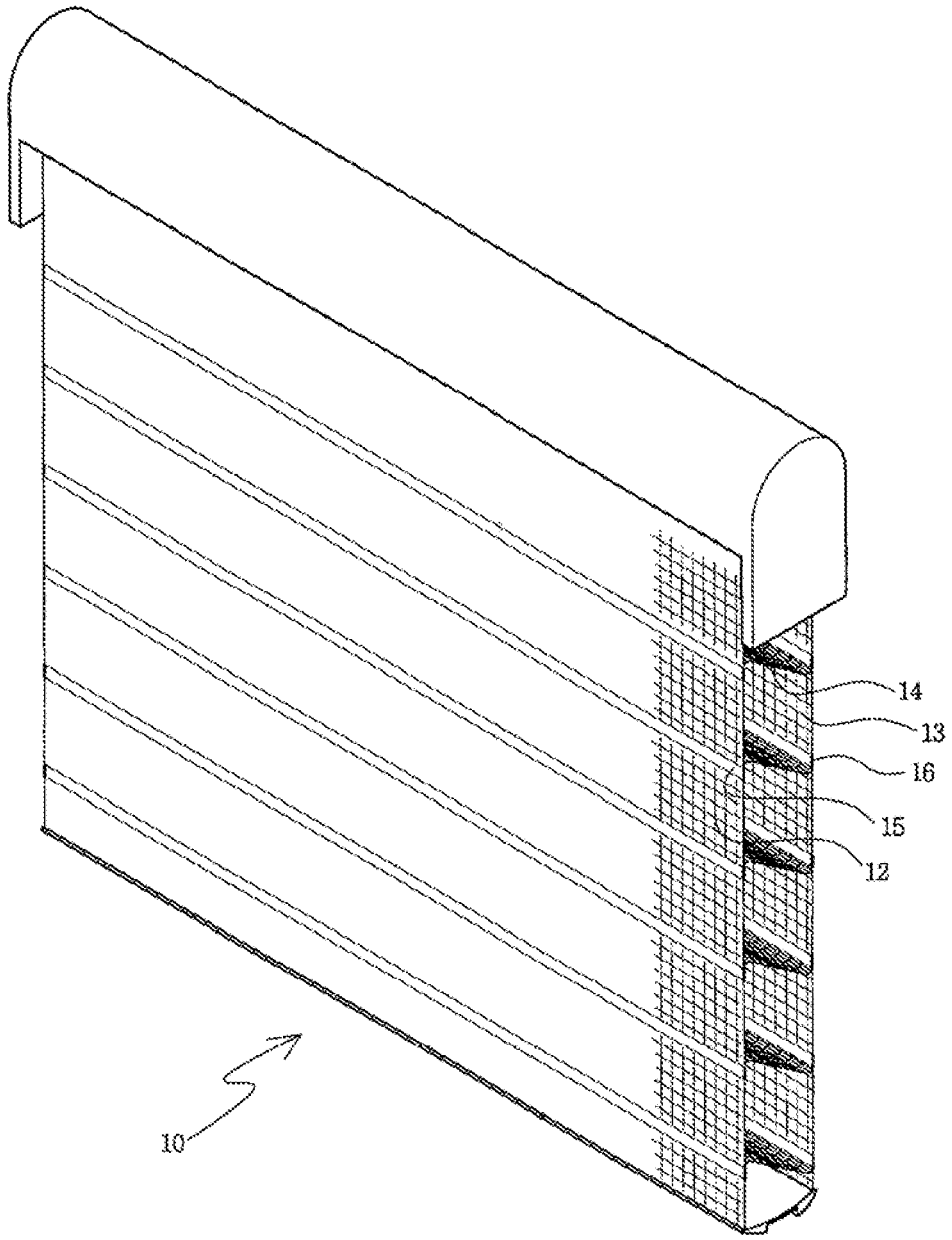

In this case, when the slat textiles are raised as shown in FIG. 8, that is, when the slat textiles 14 maintain a vertical state with respect to the bottom (i.e., flattened state), the slat textiles 14 are in close contact with the front textile 12 and the back textile 13 to block external lights.

In addition, when the slat textiles 14 are raised as shown in FIG. 8, the textile blind 10 maintains a plane state, so that the textile blind 10 can be rolled up or out as shown in FIG. 7.

When the slat textiles 14 are pulled down as shown in FIG. 9, that is, when the slat textiles 14 are pulled down until a horizontal state (or the plane state) is maintained on upper sides of the slat textiles 14 between the front textile 12 and the back textile 13, the front textile 12 and the back textile 13 become apart from each other, so that a ventilation structure can be generated to allow external airs to circulate through a mesh structure of the front textile 12 and the back textile 13. Thus, external sights can be viewed through the mesh structure, and lights can be taken in.

For reference, when the textile blind 10 maintains lighting, the slat textiles 14 between the front textile 12 and the back textile 13, instead of having a completely vertical shape, has an arc shape in the position near the front uniting part 15 and the back uniting part 16 when seen in a side view as shown in FIG. 6.

According to the present invention as described above, the front and back textiles for ventilation and the slat textiles for blocking lights can be simultaneously woven to form a textile blind 10 having several slat textiles 14.

INDUSTRIAL APPLICABILITY

Such a textile blind can be united by a weaving machine using the above described method, and can be manufactured and supplied to allow consumers to easily install and use the textile blind.

The invention claimed is:

1. A blind configured to have a plurality of states including an open state for light passage and a closed state for light blockage, the blind comprising:

a first primary textile extending from an upper portion of the blind to a lower portion of the blind;

a second primary textile extending substantially parallel to the first primary textile from the upper portion of the blind to the lower portion of the blind;

a first uniting section defined on the first primary textile and including a first slat warp;

a second uniting section defined on the second primary textile and including the first slat warp, the second uniting section being substantially level with the first uniting section when the blind is in the open state;

a third uniting section defined below the first uniting section on the first primary textile and including a second slat warp that is different from the first slat warp;

a fourth uniting section defined below the second uniting section on the second primary textile and including the second slat warp, the fourth uniting section being substantially level with the third uniting section when the blind is in the open state;

a first slat textile provided between the first and second primary textiles, the first slat textile including the first slat and being woven to the first primary textile and the second primary textile at the first uniting section and the second uniting section, respectively; and a second slat textile provided below the first slat textile and between the first primary textile and the second primary textile, the second slat textile being woven to the first primary textile and the second primary textile at the third uniting section and the fourth uniting section, respectively;

wherein the first and second primary textiles are configured to provide light passage, and the first and second slat textiles are configured to block light, and wherein the first and second slat textiles are substantially orthogonal to the first and second primary textile in the open state to provide light passage, and substantially parallel to the first and second primary textiles in the closed state to block light wherein the first primary textile includes a first primary warp and a first primary woof, the second primary textile includes a second primary warp and a second primary woof, the first slat textile includes the first slat warp and a first slat woof, and the second slat textile includes the second slat warp and a second slat woof.

2. The blind of claim 1, wherein the first primary textile includes a first primary warp and the second primary textile includes a second primary warp, and wherein the first primary warp, the second primary warp, the first slat warp, and the second slat warp are different warps.

3. The bind of claim 1, wherein first slat woof including a first thread having a first thickness and a second thread having a second thickness, the first thickness being substantially thicker than the second thickness, and wherein the second slat woof including a third thread having a third thickness and a fourth thread having a fourth thickness, the third thickness being substantially thicker than the fourth thickness.

4. The blind of claim 3, wherein the first thread of the first slat woof includes a synthetic fiber, and the second thread of the first slat woof includes a low melt fiber.

5. The blind of claim 3, wherein the first thickness is 280 denier or greater, and the second thickness is 150 denier or less.

6. A blind comprising:

a front textile woven with a first warp and a first woof and including an upper front uniting part and a lower front uniting part, the front textile being configured to provide ventilation and light passage;

a back textile woven with a second warp and a second woof and including an upper back uniting part and a lower back uniting part, the back textile being configured to provide ventilation and light passage;

a slat textile woven with a third woof and a third warp, the slat textile being a light blocking textile provided between the front textile and the back textile, wherein a fourth warp is woven with the front textile at the upper front uniting part, and at the lower back uniting part such that the slat textile couples the lower back uniting part and the upper front uniting part.

7. The blind of claim 6, further comprising a plurality of slat textiles disposed between the front textile and the back textile, each slat textile being coupled to the front textile and the back textile by corresponding front uniting parts and back uniting parts, respectively, wherein the front textile and the back textile are substantially parallel, each having a length extending from an upper portion of the blind to a lower portion of the blind, and wherein the plurality of slat textiles are arranged along the length of the front textile and the back textile.

8. The blind of claim 7, wherein the blind is configured to have an open position and a closed position, where the slat textiles are substantially orthogonal to the front textile in the open position to provide ventilation and light passage, and where slat textiles are substantially parallel to the front textile and the back textile in the closed position to block light.

9. The blind of claim 6, wherein the first and second woofs include a low melt fiber.

10. The blind of claim 9, wherein the first and second woofs include a rubber thread.

11. The blind of claim 10, wherein the third woof includes first and second threads, the first thread including a synthetic fiber and the second thread including a low melt fiber.

12. The blind of claim 6, wherein the upper front uniting part, the lower front uniting part, the upper back uniting part, and the lower back uniting part are woven with a fourth woof, and wherein the fourth woof includes first and second threads, the first thread including a synthetic fiber and the second thread including a low melt fiber.

13. A blind comprising:

a front textile having with a first warp and a first woof, the front textile being configured to provide light passage;

a back textile having with a second warp and a second woof, the back textile being configured to provide light passage;

a upper slat textile having a third warp and a third woof, the third woof being substantially thicker than the first woof of the front textile and the second woof of the back textile, the upper slat textile being a light blocking textile provided between the front textile and the back textile; and a lower slat textile having a fourth warp and a fourth woof, the fourth woof being substantially thicker than the first woof of the front textile and the second woof of the back textile, the lower slat textile being a light blocking textile provided between the front textile and the back textile, wherein the upper slat textile are woven to the front textile at an upper front uniting part and the back textile at an upper back uniting part, and wherein the lower slat textile are woven to the front textile at a lower front uniting part and the back textile at a lower back uniting part.

* * * * *